United States Patent [19]

Wang

[11] Patent Number: 4,744,106

[45] Date of Patent: May 17, 1988

[54] ENGINEERING CAP WITH STRUCTURE OF FAN DEVICE

[76] Inventor: Gong S. Wang, 2nd F., No. 71-15 Tong-Ping Rd., Tai-Ping Shiang, Tai-Chung Hsien, Taiwan

[21] Appl. No.: 16,416

[22] Filed: Feb. 19, 1987

[51] Int. Cl.[4] ..... A42C 5/04

[52] U.S. Cl. ..... 2/171.3; 2/185 R; 2/199; 2/422; 2/187; 62/259.3

[58] Field of Search ..... 2/171.3, 171.1, 185 R, 2/199, 184.5, 422, 175, 410, 198, 187; 62/259.3

[56] References Cited

U.S. PATENT DOCUMENTS

| | | | |
|---|---|---|---|
| 1,635,916 | 7/1927 | Williams | 2/187 |
| 3,496,575 | 2/1970 | Neckermann et al. | 2/198 |
| 3,881,198 | 5/1975 | Waters | 2/171.3 |
| 4,542,538 | 9/1985 | Moretti et al. | 2/422 X |
| 4,546,496 | 10/1985 | Lewis | 2/171.3 |
| 4,672,968 | 6/1987 | Lenox | 2/171.3 X |

FOREIGN PATENT DOCUMENTS

| | | | |
|---|---|---|---|
| 0825461 | 12/1951 | Fed. Rep. of Germany | 2/187 |

*Primary Examiner*—Peter Nerbun

*Attorney, Agent, or Firm*—Larson and Taylor

[57] ABSTRACT

An engineering safety cap for providing both security and ventilation. The cap according to a specific embodiment comprises a top portion, sides and an open bottom which together define an inner compartment. The top portion has a circular opening defined by axially extending walls and the opening is in communication with the inner compartment. The safety cap further includes a cylindrical cover having a motor driven fan mounted therein and which, in turn, is pivotably mounted at one edge thereof to the cap such that the cover can be positioned inside the cap opening. Magnets mounted on both the cover and the opening walls removably retain the cover in the closed position. Axially extending grooves are provided along the circumference of both the cover and the cap opening walls.

11 Claims, 3 Drawing Sheets

ENGINEERING CAP WITH STRUCTURE OF FAN DEVICE

FIELD OF THE INVENTION

This invention relates to engineering safety caps, and in particular relates to safety caps having a ventilation or fan device incorporated therein.

BACKGROUND OF THE INVENTION

There is a need to provide both convenience and comfort for engineers who must wear a safety cap under a very hot sun so that the engineers can enjoy cool ventilation air at those times. In addition, a practical solution is needed to provide such a safety cap for engineers. Preferably, such a safety cap should contain a fan that can be fitted inside the top of the cap and is driven by a motor. In addition, it would be useful if the fan inside the cap can also be used as an ordinary fan, such as when the engineer is resting under a shelter such as a tree.

SUMMARY OF THE INVENTION

Therefore, it is a purpose of the present invention to provide a device that offers a practical solution to the aforementioned needs.

It is an object of the present invention to provide a special design of a device with features that make the device easy to carry and also suitable at work sites so that its wearers do not have to worry about security on the one hand, or suffer unbearable heat on the other hand. Thus, the present invention is concerned with engineering safety caps having the structure of a fan device to provide appropriate cooling. In that way, the engineers' energy and attention can be concentrated on the development being worked on.

In a preferred embodiment, the present cap is provided with a water tight cover so that a worker can wear the cap on a rainy day and can protect the fan and the fan motor from the rain.

IN THE DRAWINGS

DETAILED DESCRIPTION OF THE PREFERRED EMBODIMENT

Figure 1:
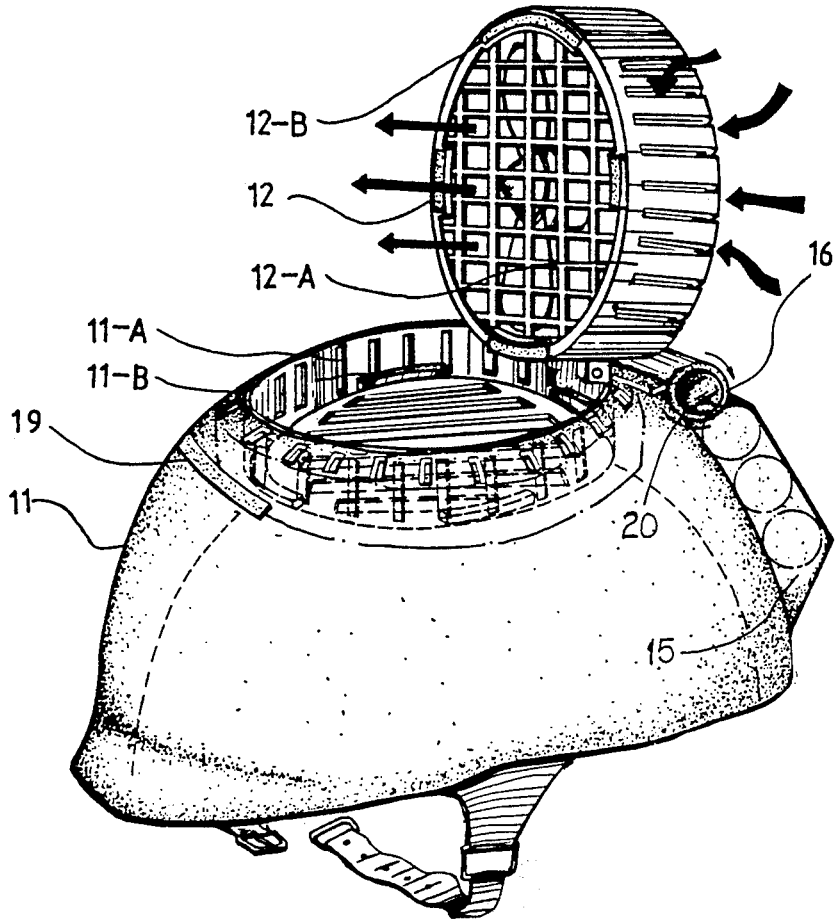
FIG. 1 is a perspective view of an embodiment of a cap structure according to the present invention.
Figure 2:
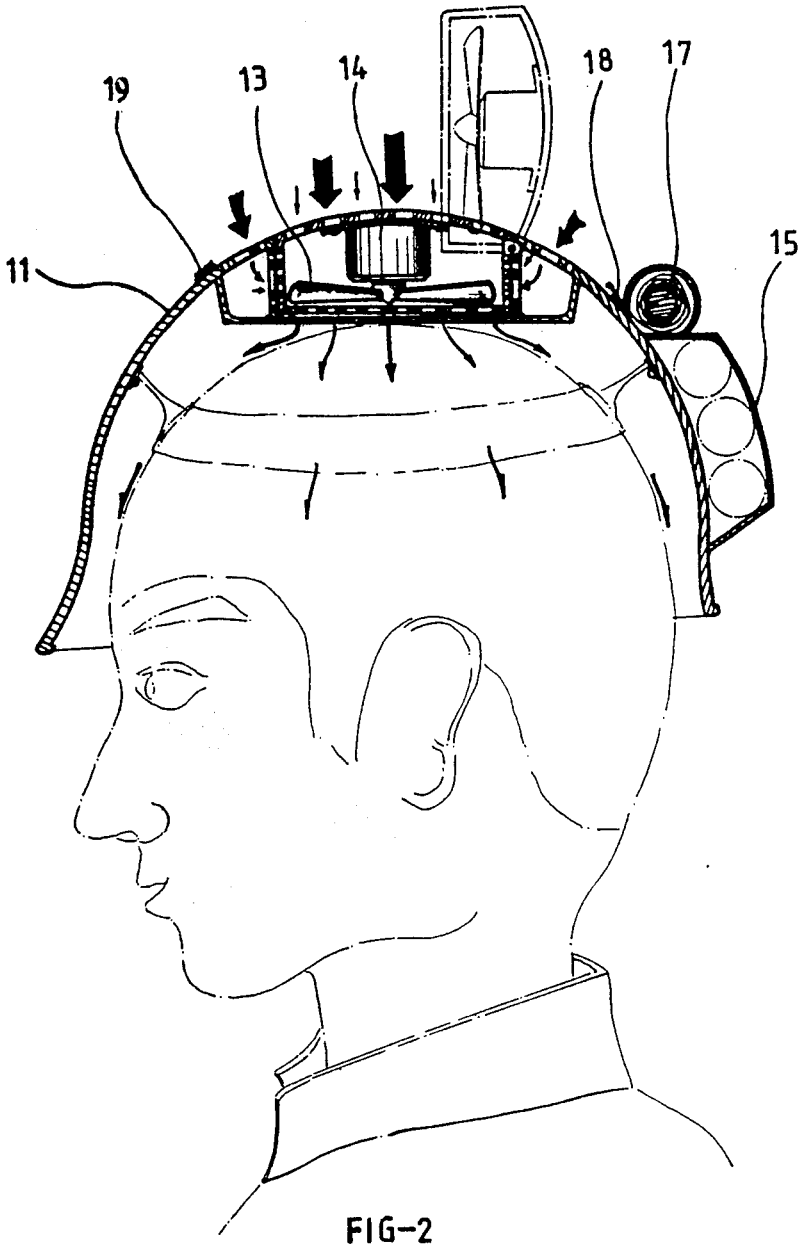
FIG. 2 is a cross-sectional view of the engineering cap of FIG. 1 shown being worn by an individual.

The newly developed structure of a fan for engineering safety caps provides convenience and comfort for engineers who can enjoy cool air wherever they wear the caps, such as under a fierce sun. The safety cap is provided with a small fan that is fitted inside the top of the cap and that is driven by a DC motor. The top of the cap is provided with a cover which is connected at one side thereof with a shaft to a major part of the cap so that the cover can be easily opened as necessary. On the side opposite to the location of the shaft is a magnet which ensures a perfect closure of the top opening of the safety cap. Located at the back of the cap is a battery compartment for containing batteries. Located between the battery compartment and the fan shaft is a cylindrical casing which contains a waterproof cloth rolled onto a shaft so that the cloth an be pulled out for covering the motor during rainy weather.

In addition, when a worker is taking a rest under a tree, the worker can simple open the top of the cap and use the small fan normally located inside the cap as an ordinary fan. Consequently, the fan has multiple functions making it practical and economical, as well as easy to carry.

Since an engineering safety cap must have a sufficient hardness and durability so as to optimize its protection function, the cap is made of F.R.P. The cap is formed in one operation to ensure the absence of any vent holes on the surface of the cap. (Vent holes in the cap material reduce stress against impact on the cap.) However, a cap made of this material makes it wearer feel unbearably hot. As a result, it has been found that some of the workers on the work site would rather wear a casual hat than a clumsy and hot safety cap.

Aware of the foregoing, the inventor of the structure of a fan for an engineering safety cap concentrated his energy and intention on the development of the present invention. After a long period of research and improvement, the present inventor achieved, finally, a success in a special design having features such that the cap is easy to carry and suitable at work sites where people no longer have to worry about security or unbearable heat from wearing the cap.

Furthermore, the present cap is also ideal for a worker to wear on a rainy day because the fan can be protected under a watertight cover.

Referring now to the drawings accompanying this specification for further information and a better understanding, the present invention will be particularly described with respect to an embodiment thereof.

Figure 3:
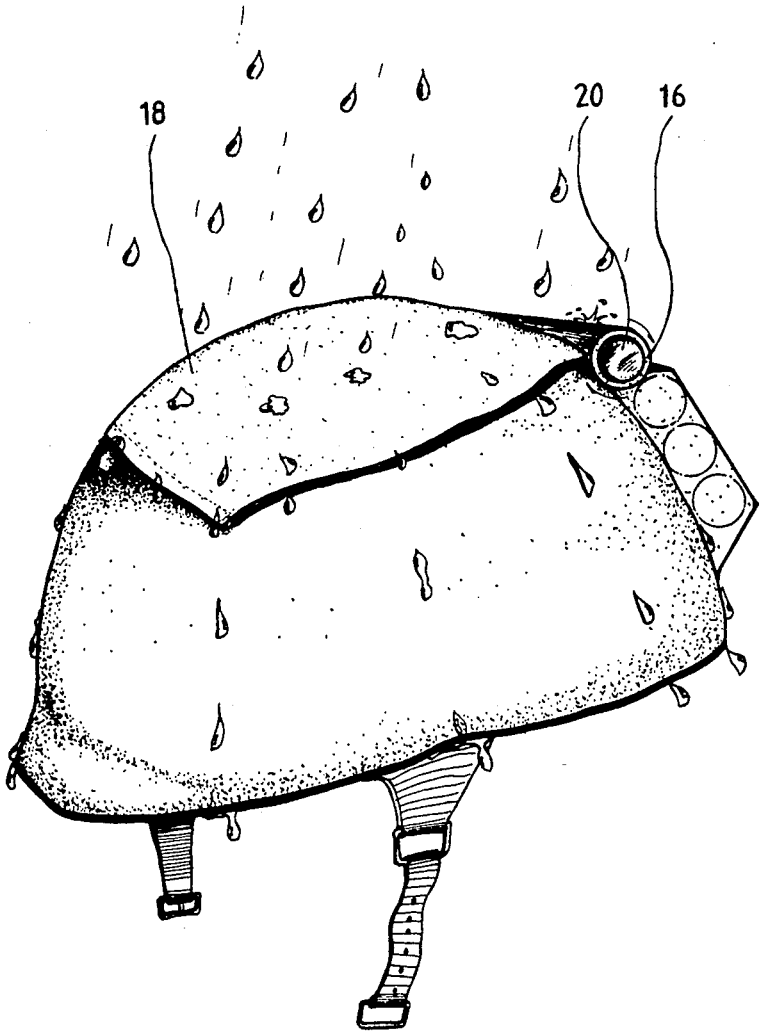
FIG. 3 is a perspective view of the present invention, somewhat similar to FIG. 1, depicting a rain cover in place.

The structure of an embodiment of a cap 11 according to the present invention is depicted. At the top of cap 11 is an opening 21 designed for a small fan 13 that is driven by a DC motor. A cover 12 for opening 21 of cap 11 is connected with the major part of cap 11 with a shaft 22. Opposite shaft 22 on cap 11 are mounted two pieces of magnets 11B and 12B. Magnet 12B is located at the edge of cover 12 and magnet 11B is located on the major part of opening 21 directly against magnet 12B. This placement of the magnets ensures retention of cover 12 inside opening 21. Care must be taken so that circumference 12A of cap cover 12 and circumference 11A of the top opening 21 of cap 11 correspond with each other to ensure a close fit so that cover 12 can be perfectly closed inside the major part of cap 11 so as to ensure a perfect fit. Vent grooves are provided around circumference 12A of cap cover 12 and the circumference 11A of the major part of cap 11 so that a more effective ventilation of the cap can be obtained when the fan operates. A battery compartment 15 is provided at the back of cap 11. A cylindrical box 16 is located on cap 11 above compartment 15. Inside cylindrical box 16 is a soft shaft 17 on which a waterproof cloth 18 has been rolled. At one end of shaft 17 is a button 20. Mounted on cap 11 near the edge of opening 21 opposite the location of shaft 22 is an adhesion plate 19 for retaining one end of cloth 18. Thus, when it rains, cloth 18 can be pulled out and the end fixed to adhesion plate 19, as shown in FIG. 3. When cloth 18 must be rewound, button 20 can be turned and cloth 18 will roll up around shaft 17 in cylindrical box 16. Since shaft 17 is soft, cloth 18 is prevented from loosening.

What is claimed is:

1. A protective engineering safety cap device including means for removing heat comprising in combination a cap having a top portion, sides and an open bottom, which together define an inner compartment, said top portion having an opening defined by walls in said cap, said opening being in communication with said inner compartment;

a cover having at least a portion with a circumference sized and shaped so as to fit in said top portion opening in close proximity to said opening walls;

a motor driven fan mounted in said cover;

means for pivotably attaching said cover to said cap such that said cover can be positioned between a first closed position in which said cover closes said opening, and a second, opening position; and means for removably retaining said cover in said closed position.

2. The engineering safety cap device as claimed in claim 1 wherein said cap cover has elongate vent grooves around the circumference of said cover portion that fits in said cap opening; and wherein said opening walls have elongate vent grooves around the circumference thereof.

3. The engineering safety cap device as claimed in claim 2 wherein said cap further includes a waterproof shield means for providing a waterproof shield over said cover, said means including a housing mounted to said cap adjacent said cover attaching means, a soft shaft rotatably mounted in said housing, and a waterproof cloth rolled around said shaft and having a free end.

4. The engineering safety cap device as claimed in claim 3 wherein said waterproof shield means further includes means for removably attaching said cloth free end to said cap.

5. The engineering safety cap device as claimed in claim 3 wherein said waterproof shield means further includes means for rewinding said cloth.

6. The engineering safety cap device as claimed in claim 1 wherein said cap further includes a waterproof shield means for providing a waterproof shield over said cover, said means including a housing mounted to said cap adjacent said cover attaching means, a soft shaft rotatably mounted in said housing, and a waterproof cloth rolled around said shaft and having a free end.

7. The engineering safety cap device as claimed in claim 6 wherein said waterproof shield means further includes means for removably attaching said cloth free end to said cap.

8. The engineering safety cap device as claimed in claim 6 wherein said waterproof shield means further includes means for rewinding said cloth.

9. The engineering safety cap device as claimed in claim 1 wherein said cover is substantially cylindrical and has an upper axial face and a lower axial face that opposes said inner compartment.

10. The engineering safety cap device as claimed in claim 9 wherein said cap top portion further includes a housing member having a bottom and walls and extending axially below said opening into said inner compartment, said housing member receiving said fan when said fan is positioned in said first closed position, said housing member walls having axially extending, elongate vent grooves around the circumference thereof and further having vent openings in the bottom thereof such that said housing member bottom is a screen.

11. The engineering safety cap device as claimed in claim 9 wherein said retaining means comprises a first magnet mounted on said cap opening walls and a second magnet mounted near the circumferential edge of said cover lower axial face at a location so as to be in a mating position when said cover is in said closed position.

* * * * *